United States Patent [19]

Shiina

[11] Patent Number: 4,853,179

[45] Date of Patent: Aug. 1, 1989

[54] METHOD OF MANUFACTURING HEAT RESISTANT, HIGH-STRENGTH STRUCTURAL MEMBERS OF SINTERED ALUMINUM ALLOY

[75] Inventor: Haruo Shiina, Saitama, Japan

[73] Assignee: Honda Giken Kogyo Kabushiki Kaisha, Tokyo, Japan

[21] Appl. No.: 921,999

[22] Filed: Oct. 22, 1986

[30] Foreign Application Priority Data

Oct. 22, 1985 [JP] Japan ..... 60-234503

[51] Int. Cl.[4] ..... B22F 3/24

[52] U.S. Cl. ..... 419/28; 419/33; 419/41; 419/52; 419/67

[58] Field of Search ..... 419/28, 52, 41, 67, 419/33

[56] References Cited

U.S. PATENT DOCUMENTS 4,335,494 6/1982 Lemelson ..... 419/3
4,380,473 4/1983 Lichtinghagen ..... 419/52
4,435,213 3/1984 Hildeman et al. ..... 419/31
4,702,885 10/1987 Odani et al. ..... 419/67

*Primary Examiner*—Stephen J. Lechert, Jr.
*Attorney, Agent, or Firm*—Lyon & Lyon

[57] ABSTRACT

This invention relates to a method of manufacturing a structural member made of a sintered Al alloy having heat resistance and high strength. A powder is used having a composition which makes it difficult to perform hot forging, i.e. 8.0 to 30.0 wt. % of Si, 0.8 to 7.5 wt. % of Cu, 0.3 to 3.5 wt. % of Mg, 2.0 to 10.0 wt. % of Fe, 0.5 to 5.0 wt. % of Mn, and a balance of Al. After being subjected to press-forming, this Al alloy powder is subjected to hot extrusion at a temperature of 300° to 450° C., the extruded product is heated with electric resistance heating by electric current which is passed therethrough and subjected to forging at a temperature of 300° to 495° C. According to this method, a structural member made of a sintered Al alloy having heat resistance and high strength and having the aforementioned powder composition can be easily obtained without cracking.

8 Claims, 3 Drawing Sheets

METHOD OF MANUFACTURING HEAT RESISTANT, HIGH-STRENGTH STRUCTURAL MEMBERS OF SINTERED ALUMINUM ALLOY

BACKGROUND OF THE INVENTION

The field of the present invention is manufacturing methods for heat-resistant, high-strength structural members made of sintered aluminum alloy.

Lightweight alloys such as aluminum alloys are highly suitable for the moving parts of an internal combustion engine since they have low inertia and lighten the weight of the entire engine. In particular, parts made of sintered aluminum alloys by powder metallurgy methods greatly contribute to improved engine performance due to their increased heat resistant, strength, and Young[s modulus obtained by the addition of various kinds of alloying elements.

Conventionally, heat-resistant, high-strength parts made of a sintered aluminum alloy and containing a large amount of iron and silicon are formed by compressing metal powder into a billet which is then extruded to form a rod. The rod is then hot forged to form the desired part. However, if a preheated material for the hot forging is put into a forging metal mold, the material is cooled by the metal mold, resulting in degradation of the ductility of the material and the formation of cracks during the hot forging. To prevent these problems, it is effective to employ a constant temperature forging method in which forging is performed using a heated metal mold. However, complicated and large-sized equipment is required to maintain the metal mold and the material at a predetermined temperature. These requirements increase the cost of the resulting products.

SUMMARY OF THE INVENTION

Accordingly, the object of the present invention is to provide a method for working hot extruded rod material made of aluminum alloy powder having a composition making it otherwise difficult to perform hot plastic working.

The above object can be obtained by plastic deformation of a rod made of aluminum alloy powder while the rod is heated by passing an electric current therethrough.

One example of an aluminum sintered alloy member to which the present invention is applied may contain Si, Cu, Mg, Fe and Mn in the following amounts: 8.0–30.0 wt.% Si, 0.8–7.5 wt. % Ci, 0.3–3.5 wt. % Mg., 2.0–10 wt. % Fe, 0.5–5.0 wt. % Mn, and a balance consisting of inevitable impurities and Al. Alternatively, it may further contain at least one element selected from the group consisting of Zn, Li, and Co in addition to Si, Cu, Mg, Fe, and Mn in the following quantities; 8.0–30.0 wt. % Si, 0.8–7.5 wt. % Cu, 0.3–3.5 wt. % Mg, 2.0–10.0 wt. % Fe, 0.5–5.0 wt. % Mn, 0.5–10.0 wt. % Zn, 1.0–5.0 wt. % Li, 0.5–3.0 wt. % Co., and a balance of inevitable impurities and Al.

DETAILED DESCRIPTION OF THE EMBODIMENTS

Figure 1:
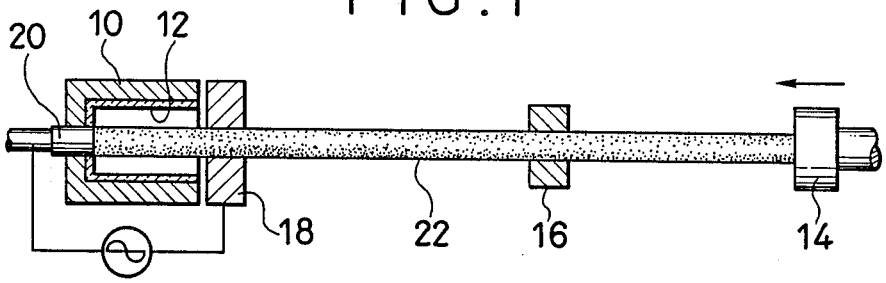
FIGS. 1 and 2 are schematic views showing examples of an upset forging method according to the present invention.

If Fe and Si are added to Al, the high temperature strength and Young's modulus thereof can be increased. However, acicular intermetallic compounds such as $Al_3Fe$ and $Al_{12}Fe_3Si$ are deposited. As a result the hot forging performance of the material is reduced and the sintering properties and resistance to stress corrosion cracking deteriorate. Accordingly, it is effective to decrease the Fe content and to add Cu and Mg, which results in the strengthening of the Al matrix with heat treatment. Also, hot forging properties and the resistance to stress corrosion cracking are improved by the addition of Mn.

Furthermore, age hardening is promoted by adding Zn, an increase in the alloy density is restrained by adding Li, and the high-temperature strength can be increased by adding Co, which compensates for the decreased amount of Fe.

The reasons for the addition of the above-mentioned elements to which the present invention is concerned are as follows:

(1) Fe

Fe improves high-temperature strength and Young's modulus. If the Fe content is less than 2.0 wt. %, no improvement in the high temperature strength can be expected. On the other hand, if it exceeds 10.0 wt. %, high speed hot forging becomes practically impossible. Thus, in accordance with the present invention, the Fe content is in the range of about 2.0–10.0 wt. %.

(2) Si

Si contributes to an increase in abrasion resistance and Young's modulus, restrains the coefficient of thermal expansion and improves thermal conductivity. It is necessary to add at least 8.0 wt. % for it to be effective, while if the added amount exceeds 30.0 wt. %, workability is degraded during extrusion and forging which often results in the formation of cracks in the resulting structural member. Therefore, the Si content is defined as being in the range of about 8.0–30.0 wt. %.

(3) Cu

Cu is effective for strengthening an Al matrix by heating. Addition of less than 0.8 wt. % of Cu provides little effect, while if the added amount exceeds 7.5 wt. %, the resistance to stress corrosion cracking deteriorates and hot forging performance is lowered. Therefore, the Cu content is defined as being in the range of about 0.8 to 7.5 wt. %.

(4) Mg.

Like Cu, Mg is effective for strengthening an Al matrix by heating. Addition of less than 0.3 wt. % of Mg produces little effect, while fi the added amount exceeds 3.5 wt. %, resistance to stress corrosion cracking and hot forging performance are reduced. The Mg content is accordingly defined as being in the range of about 0.3–3.5 weight %.

(5) Mn

Mn is an important component particularly when the Fe content is at least 4 wt. %. Mn contributes to improvements in high temperature strength, hot forging performance, and resistance to stress corrosion cracking. If the Mn content is less than 0.5 wt. %, its addition produces little effect, and if it exceeds 5.0 wt. %, it adversely affects hot forging performance. Accordingly, the Mn content is defined as being in the range of about 0.5–5.0 wt. %.

(6) Zn

In order to improve the strength of a member used at a temperature of 200° C. or less, it is effective to subject the member to T6 treatment (artificial age hardening treatment after solution heat treatment) and to employ hardening due to deposition of an intermetallic compound produced by the addition of Si, Cu and Mg. Zn has the ability to promote age deposition. If the Zn content is less than 0.5 wt. %, the aforementioned effect is unobtainable, while if ti exceeds 10 wt. % hot deformation resistance is increased and high speed hot forging becomes difficult to perform. Accordingly, the Zn content is defined as being in the range of about 0.5–10.0 wt. %.

Heretofore, when Zn was added as an effective element, Si contained in an Al alloy was regarded as an impurity. However, by employing powder metallurgy methods, it becomes possible to actively employ both Zn and Si as additives. The abrasion resistance can be increased and the coefficient of thermal expansion can be lowered by the primary crystal of Si, and the strength of the material can be increased by using the hardening due to deposition of a Zn compound.

In this way, since the strength of a structural member after T6 treatment can be improved by adding Zn, it becomes possible to lessen the density of the structural member by reducing the Fe content, and to improve the hot forging properties.

(7) Li

Li is used to restrain the increase in alloy density due to the addition of Fe, and the restraining effect increases as the Li content is increased. Li is also effective to increase the Young's modulus of the alloy and give it a high rigidity. If the Li content is less than 1.0 wt. %, it has little effect on restraining an increase in density, while if it exceeds 5.0 wt. %, manufacturing becomes complicated due to the activity of Li. Therefore, the Li content is defined as being in the range of about 1.0–5.0 wt. %.

(8) Co.

Co is effective for improving high temperature strength when the Fe content is decreased in order to improve forging workability. It can improve tensile strength, yield strength, and fatigue strength without sacrificing ductility, and also can improve high-temperature strength without decreasing forging workability and the resistance to stress corrosion cracking. If the Co content is less than 0.5 wt. %, it produces little effect, and if it exceeds 3.0 wt. %, the additional improvement become relatively less significant as the added amount thereof increases. Moreover, since Co is expensive, it is undesirable to add large amounts thereof. Accordingly, the Co content is defined as being in the range of about 0.5–3.0 wt. %.

Next, there will be described hereunder preferable examples of an Al alloy composition used in the method of the present invention.

(1) $14 \leqq Si \leqq 18$ wt. %, $2.0 \leqq Cu \leqq 5.0$ wt. %, $0.3 \leqq Mg \leqq 1.5$ wt. %, $3.0 \leqq Fe \leqq 6.0$ wt. %, and $0.5 \leqq Mn \leqq 2.5$ wt. %:

In this example, Fe was restrained to less than 6 wt. % to improve the resistance to stress corrosion cracking and to maintain hot forging workability, while Mn was added to improve high-temperature strength. Cu and Mg are effective for improving the strength of an Al matrix by heat treatment, and are effective in members for use in an environment in which the temperature is about 150° C.

(2) $14 \leqq Si \leqq 18$ wt. %, d $2.0 \leqq Cu \leqq 5.0$ wt. %, $0.3 \leqq Mg \leqq 1.5$ wt. %, $3.0 \leqq Fe \leqq 6.0$ wt. %, $0.5 \leqq Mn \leqq 2.5$ wt. %, and $1.0 \leqq Co \leqq 2.0$ wt. %:

Co in this composition range is effective for improving high temperature strength when the Fe content is restrained to a range in which it will have no adverse effect on resistance to stress corrosion cracking and for inability.

(3) $14 \leqq Si \leqq 18$ wt. %, $2.0 \leqq Cu \leqq 5.0$ wt. %, $0.3 \leqq Mg \leqq 1.5$ wt. %, $3.0 \leqq Fe \leqq 6.0$ wt. %, $0.5 \leqq Mn \leqq 2.5$ wt. %, and $2.0 \leqq Li \leqq 4.0$ wt. %:

Li in this composition range can restrain an increase in alloy density accompanying the addition of Fe.

(4) $14 \leqq Si \leqq 18$ wt. %, $2.0 \leqq Cu \leqq 5.0$ wt. %, $0.3 \leqq Mg \leqq 1.5$ wt. %, $3.0 \leqq Fe \leqq 6.0$ wt. %, $0.5 \leqq Mn \leqq 2.5$ wt. %, and $2.0 \leqq Zn \leqq 4.0$ wt. %:

By heat treatment, Zn in this composition range can improve strength at a temperature of 200° C. or less.

A structural member made of a sintered Al alloy having the above-mentioned composition can be obtained through the following steps. In particular, a connecting rod for an internal combustion engine can be advantageously manufactured by this method.

(1) Powder manufacturing step:

An alloy powder can be obtained from an Al alloy hot melt having the desired composition by atomization, for example. At that time, if the cooling speed of the hot melt is less than $10^{3}$° C./sec., coarse deposits of an intermetallic compound such as $Al_3Fe$, $Al_{12}Fe_3Si$, and $Al_9Fe_2Si_2$ are produced, and these deposits cause a decrease in strength of the resulting member. The size of the deposits is preferably 10 μm or less, and as a general rule, a suitable hot melt cooling speed is $10_3$° C./sec. If the size of deposition is 10 μm or more, improved fatigue strength cannot be expected and formability deteriorates.

(2) Powder pressing step:

Forming is performed in air at a forming temperature of 350° C. or less and under a forming pressure of 1.5 ton/$cm_2$ to 5.0 ton/$cm_2$ to obtain a green compact having a density ratio of 70% or more. The reason for these conditions is that if the forming temperature exceeds 350° C., oxidation of the powder surface progresses and the sintered ability in the following extrusion step deteriorates. In order to prevent oxidation, forming may be performed in an inactive atmosphere. However, since doing so lowers productivity and profitability, forming in air is recommended. If the forming pressure is less than 1.5 ton/$cm_2$, it is difficult to handle the green compact without breaking it, and as a result, mass production becomes difficult. On the other hand, if it exceeds 5.0 ton/$cm_2$, the service life of the metal mold is shortened and the forming equipment becomes massive, both of which are impediments to mass production. The density ratio is determined by the forming pressure. If it is 70% or less, the green compact becomes difficult to handle, which results in lower productivity and is a cause of a decrease in the strength of the resulting structural member. On the other hand, taking into consideration formability in the succeeding step (chiefly, an extrusion step), it is preferable for the density ratio to be at most 85%.

(3) Extrusion step:

An extrusion member in the form of a green compact is extruded in a temperature range of 300° to 450° C. If the working temperature is less than 300° C., treatment becomes difficult to perform. In particular, when an Fe content of the material is increased, the powder hardness is raised, thereby decreasing the sinterability. Therefore, the extrusion temperature should be at lest 300° C. If the working temperature exceeds 450° C., crystal particles and intermetallic compounds grow and the mechanical properties which are required of the resulting structural member become unobtainable. In particular, as the amount of added elements is increased, the eutectic temperature is lowered, burning can take place easily, and sinterability deteriorates. Therefore, treatment must be carried out at a temperature of no higher than 450° C.

In order to avoid oxidation of the formed product, extrusion is preferably performed in a non-oxidizing atmosphere of argon gas, nitrogen gas, etc.

(4) Forging Step (see FIGS. 1 through 5):

A hot extruded rod 22 obtained in the preceding step is disposed in a preliminary forming metal mold 10 (its inner wall is covered with a thermally and electrically insulating ceramic 12 such as $Si_3N_4$ which was preheated to 50° C. The rod 22 passes through the center of a guide member 16, and one end abuts against a punch 14. While an electric current is passed through the rod 22 via a pair of electrodes 18 and 20, upset forging is effected by advancing the punch 14 in the direction of the arrow in FIG. 1 (perforging step). The temperature of that portion of the rod 22 which is heated by the electric current must be maintained in the range of 300° to 495° C. If the forging temperature is 300° C. or less, the resistance to deformation is increased, resulting in a decrease in forging workability, and if it exceeds 495° C., the mechanical properties of the resulting product are degraded.

The thus-obtained rough formed product 24 or rough formed product 25 is subjected to finish forging using upper and lower split metal molds at a temperature of 300° to 495° C. to obtain a finished product. This finished formed product 26 is subjected to the necessary mechanical treatment to obtain a final product.

The rough formed product 25 is obtained by using a square metal mold. Since it is similar in shape to finished product 26, the percent reduction in the subsequent step of finish forging can be decreased, resulting in a decrease in product defects such as cracks.

According to the aforementioned forging method, upset forging of a material having a sufficiently long length compared with its diameter can be effected without difficulty, and a sound product without cracks can be obtained.

TEST EXAMPLE

First Step:

The Al alloy powders having the compositions shown in Table 1 were manufactured by atomizing with a cooling speed of $10_3$° to $10_4$° C./sec. and green compacts for extrusion having a density ratio of 755 were made by cold hydrostatic pressure pressing (CIP) or metal mold compression forming.

For the cold hydrostatic pressure pressing, alloy powder was put into a rubber tube, and compacted under a hydrostatic pressure of about 1.5 to 3.0 ton/$cm_2$. For the metal mold compression forming, the alloy powder was put into a metal mold, and compacted under a pressure of about 1.5 to 3.0 ton/$cm_2$ at ordinary temperature in air.

Second Step:

The members for extrusion were put into a holding furnace at a furnace temperature of 400° C. and left therefor four hours. Next, the materials for extrusion were subjected to hot extruding to obtain materials for forging (18×450 mm).

The extrusion method may be either direct extrusion (forward extrusion) or indirect extrusion (backward extrusion) but requires an extrusion ratio of at least 5. If the extrusion ratio is less than 5, the strength of the resulting members vary greatly, which is undesirable.

Figure 2:
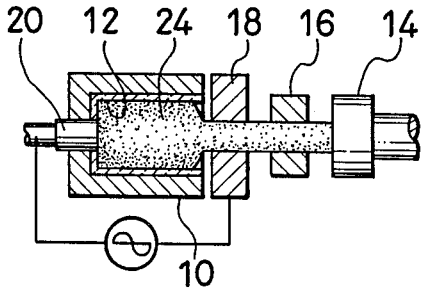
Figure 3:
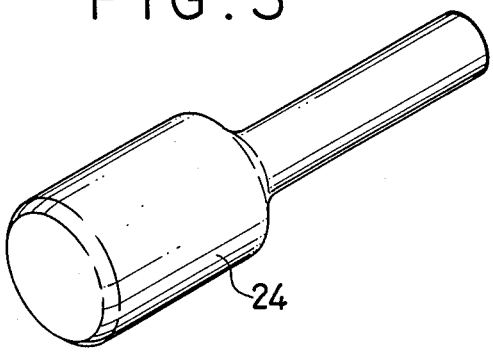
FIG. 3 is a perspective view of a rough molded product obtained by the above forging method.
Figure 4:
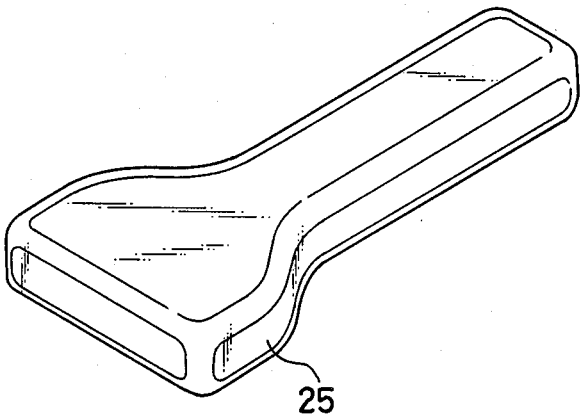
FIG. 4 is a perspective view of a finished molded product obtained by working the above rough molded product.
Figure 5:
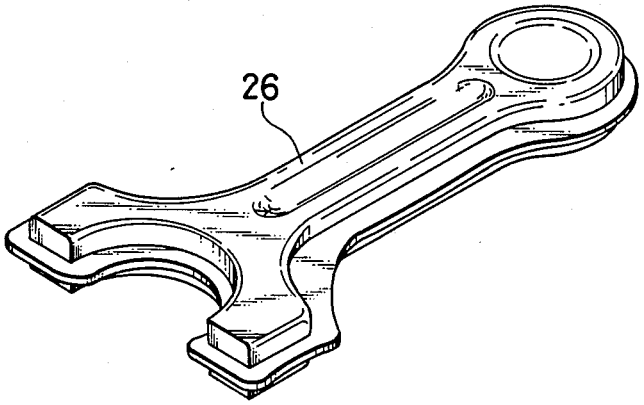
FIG. 5 is a perspective view of a finished molded product obtained by finishing the rough molded product shown in FIG. 4 by finish forging.

Third Step:

Next, according to the method of the present invention, the materials for forging (rods members) were supplied with an electric current of 200 V×150 A by using the upset forging apparatus shown in FIGS. 1 and 2 and were subjected to upset forging employing a force of 1 ton, a working speed of 16 mm/sec., and a metal mold temperature of 50° C. The obtained rough products measured 44×70 mm in their large diameter portion.

TABLE I

| TEST MATERIAL | COMPOSITION | | | | | | | |
|---|---|---|---|---|---|---|---|---|
| | Si | Cu | Mg | Fe | Mn | Zn | Li | Co |
| I | 17.2 | 4.5 | 1.2 | 4.3 | 1.8 | — | — | — |
| II | 17.9 | 2.5 | 0.5 | 4.3 | 1.8 | — | — | — |
| III | 17.2 | 4.5 | 1.0 | 4.2 | 0.8 | — | — | — |
| IV | 17.2 | 2.5 | 0.5 | 4.2 | 0.8 | — | — | — |
| V | 17.6 | 2.5 | 0.5 | 4.0 | 1.0 | — | — | 1.5 |
| VI | 17.2 | 4.5 | 1.2 | 4.3 | 1.8 | — | 2.5 | — |
| VII | 17.2 | 2.5 | 0.5 | 4.2 | 0.8 | 2.5 | — | — |

Figure 6:
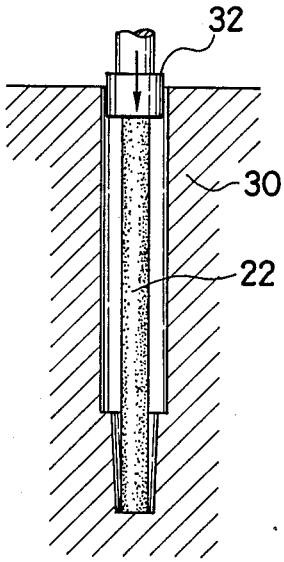
FIGS. 6 and 7 are schematic views showing known upset forging methods.
Figure 7:
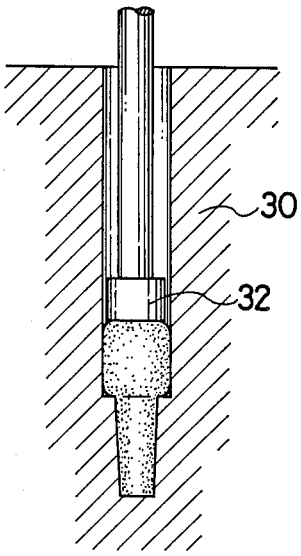

Test materials I through VII were also treated using a conventional method. Namely, the materials for forging (rods) obtained in the second step were heated within an electric furnace at a temperature of 490° C. and thereafter subjected to upset forging using a metal mold 30 and a punch 32 with a force of 12 tons, an extrusion speed of 75 mm/sec., and a metal mold temperature of 80° C. (see FIGS. 6 and 7).

TABLE 2

| TEST MATERIAL | METHOD OF PRESENT INVENTION | CONVENTIONAL METHOD |
|---|---|---|
| I | no | yes |
| II | no | yes |
| III | no | yes |
| IV | no | yes |
| V | no | yes |
| VI | no | yes |
| VII | no | yes |

The resulting forged rough products obtained by the method of the present invention and the conventional method were checked for the presence of cracks. Although cracks were found in the rough products according to the conventional method, no cracks were found in those according to the present invention (see Table 2).

As is apparent from the foregoing description, according to the method of the present invention in which pressing and forming is performed while the member is heated by electric resistance by passing an electric current therethrough, a hot extrusion rod having a composition in a range in which it is difficult to perform hot plastic working can be easily formed without cracking, and an inexpensive structural member made of a sintered Al alloy having heat resistance an high-temperature strength can be obtained.

What is claimed is:

1. A manufacturing method for a structural member having heat resistance and high strength and made of an Al alloy powder of a composition making it difficult to perform hot plastic working, comprising the steps of:

a. producing from said Al alloy powder by an extrusion process a hot extruded rod of substantially uniform shape; and b. forming said hot extruded rod under pressure into the desired shape while heating at least part of said extruded rod via electric resistance heating by passing an electric current therethrough.

2. A manufacturing method according to claim 1 in which said extrusion process includes the steps of:

a. obtaining an Al alloy powder by an atomizing process;

b. press-forming said Al alloy powder at temperature of about 350° C. to obtain a material for extrusion having a density ratio of from about 70% to about 85%, and c. extruding said material for extrusion at a temperature of from about 300° to about 450° C.; and said forming step includes the steps of:

d. heating said extruded product via electric resistance heating by passing an electric current therethrough, and e. forging said extruded product at a temperature of from about 300° C. to about 495° C.

3. A manufacturing method according to claim 2 in which the composition of Al alloy powder comprises from about 8.0 to about 30.0 wt. % of Si, from about 0.8 to about 7.5% of Cu; from about 0.3 to about 3.5 wt. % of Mg, from about 2.0 to about 10.0 wt. % of Fe, from about 0.5 to 5.0 wt. % of Mn, and a balance of Al.

4. A manufacturing method according to claim 3 which includes at least one alloy element selected from the group consisting of Zn, Li, and Co in the composition range of 0.5 wt. to 10.0 wt. % of Zn, 1.0 to 5.0 wt. % of Li, and 0.5 to 3.0 wt. % of Co.

5. A manufacturing method for a structural member made of a sintered Al alloy having heat resistance and high strength, comprising the steps of: hot extruding an Al alloy powder containing 8.0 to 30.0 wt. % of Si and 2.0 to 10.0 wt. % of Fe to obtain a hot extruded rod having a uniform shape; and forming said hot extruded rod under pressure while heating a part of said rod with electric resistance heating by passing an electric current therethrough to obtain a formed body having an enlarged, disuniform cross-section.

6. A manufacturing method for a structural member made of sintered Al alloy having heat resistant properties and high strength according to claim 5 which comprises a first step of obtaining an Al alloy powder by an atomizing method, a second step of press-forming said Al alloy powder at a temperature of 350° C. to obtain a material for extrusion having a density ratio of 70 to 85%, a third step of extruding the material for extrusion at a temperature of 300° to 450° C., and a fourth step of heating with electric resistance heating by passing an electric current through said extruded product and forging it at a temperature of 300° to 495° C.

7. A manufacturing method for a structural member made of a sintered Al alloy according to claim 5 characterized in that the composition of said Al alloy powder is 8.0 to 30.0 wt. % of Si, 0.8 to 7.5 wt. % of Cu, 0.3 to 3.5 wt. % of Mg, 2.0 to 10.0 wt. % of Fe, 0.5 to 5.0 wt. % of Mn, and a balance of Al.

8. A manufacturing method for a structural member made of a sintered Al alloy having heat resistance and high strength according to claim 7 which includes at least one alloy element selected from the group consisting of Zn, Li, and Co in the composition range of 0.5 to 10.0 wt. % of Zn, 1.0 to 5.0 wt. % of Li, and 0.5 to 3.0 wt. % of Co.

* * * * *